United States Patent [19]

Strawson et al.

[11] 4,161,377

[45] Jul. 17, 1979

[54] MOULDING APPARATUS

[75] Inventors: Kenneth H. Strawson, Sheffield; Joseph Ramsey, Mexborough, both of England

[73] Assignee: National Research Development Corporation, London, England

[21] Appl. No.: 911,210

[22] Filed: May 31, 1978

[30] Foreign Application Priority Data

Jun. 15, 1977 [GB] United Kingdom ..... 25138/77

[51] Int. Cl.[2] ..... B30B 9/28

[52] U.S. Cl. ..... 425/3; 425/84; 425/85; 425/574; 425/575

[58] Field of Search ..... 425/3, 84, 85, 86, 574, 425/575

[56] References Cited

U.S. PATENT DOCUMENTS

| | | | |
|---|---|---|---|
| 3,019,505 | 2/1962 | Vanden Berge et al. | 425/84 |
| 3,085,291 | 4/1963 | Haes et al. | 425/3 |
| 3,234,598 | 2/1966 | Quinn | 425/3 |
| 3,585,691 | 6/1971 | Wingblade et al. | 425/84 |
| 3,602,287 | 8/1971 | Eversdyk | 425/86 X |
| 3,804,576 | 4/1974 | Hehl | 425/575 X |
| 3,881,853 | 5/1975 | Laubier | 425/3 X |
| 3,989,581 | 11/1976 | Kober et al. | 425/84 X |

*Primary Examiner*—J. Howard Flint, Jr.

[57] ABSTRACT

Moulding apparatus including a die, a first hydraulic ram member for opening and closing the die and a second ram member, contained within the first ram member, for injecting mouldable material into the die. The apparatus may be for moulding permanent magnet compacts in which case means may be provided for maintaining a magnetic field around the material in the die.

5 Claims, 7 Drawing Figures

MOULDING APPARATUS

The invention relates to moulding apparatus. In particular, but not exclusively, the invention relates to the moulding of permanent magnet compacts in a compactable material containing ferrite particles, and the primary object of the invention is to provide such a machine by means of which such compacts of material can be produced at a very high rate of production and at relatively low unit cost.

According to the invention, there is provided moulding apparatus including means for opening and closing a die and means for injecting mouldable material into the die, the means for opening and closing the die being constituted by a first annular piston and cylinder arrangement and the means for injecting the mouldable material into the die including a second annular piston and cylinder arrangement disposed within said first piston and cylinder arrangement. The means for injecting the mouldable material into the die may include an injector assembly constituted by a ram member, through which extends a material feed passage, the ram member slidably extending into a cylinder forming a reservoir for a quantity of the mouldable material, said cylinder being carried by the piston of the second piston and cylinder arrangement. When the mouldable material is an abrasive slurry material or heavy contaminant, quick release means will preferably be provided whereby the cylinder which forms a reservoir for a quantity of the mouldable material, and the ram member which extends into it, can easily be removed for replacement. The first annular piston and cylinder arrangement will preferably be hydraulically connected to the second annular piston and cylinder arrangement so that the clamping force holding the die closed increases in accordance with the pressure of the mouldable material and so that any leakage of hydraulic pressure for holding the dies closed will immediately reduce the pressure of the mouldable material. When the apparatus is for moulding permanent magnet compacts in a mouldable slurry material including ferrite particles, means will preferably be provided for maintaining a magnetic field around the material in the or each die cavity during each moulding operation so that the particles of ferrite material are appropriately orientated whilst still suspended in the slurry.

Figure 1:
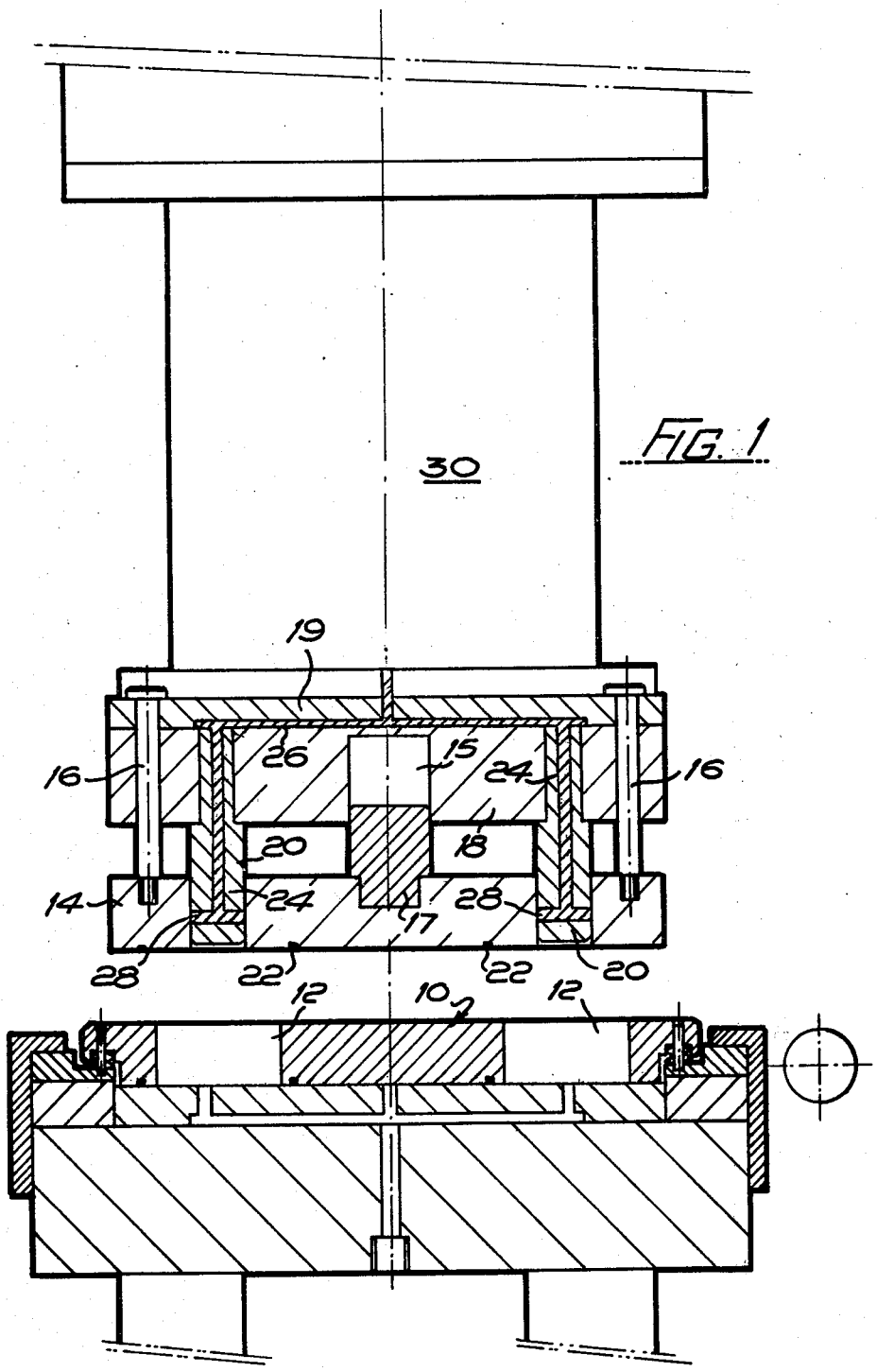
Figure 2:
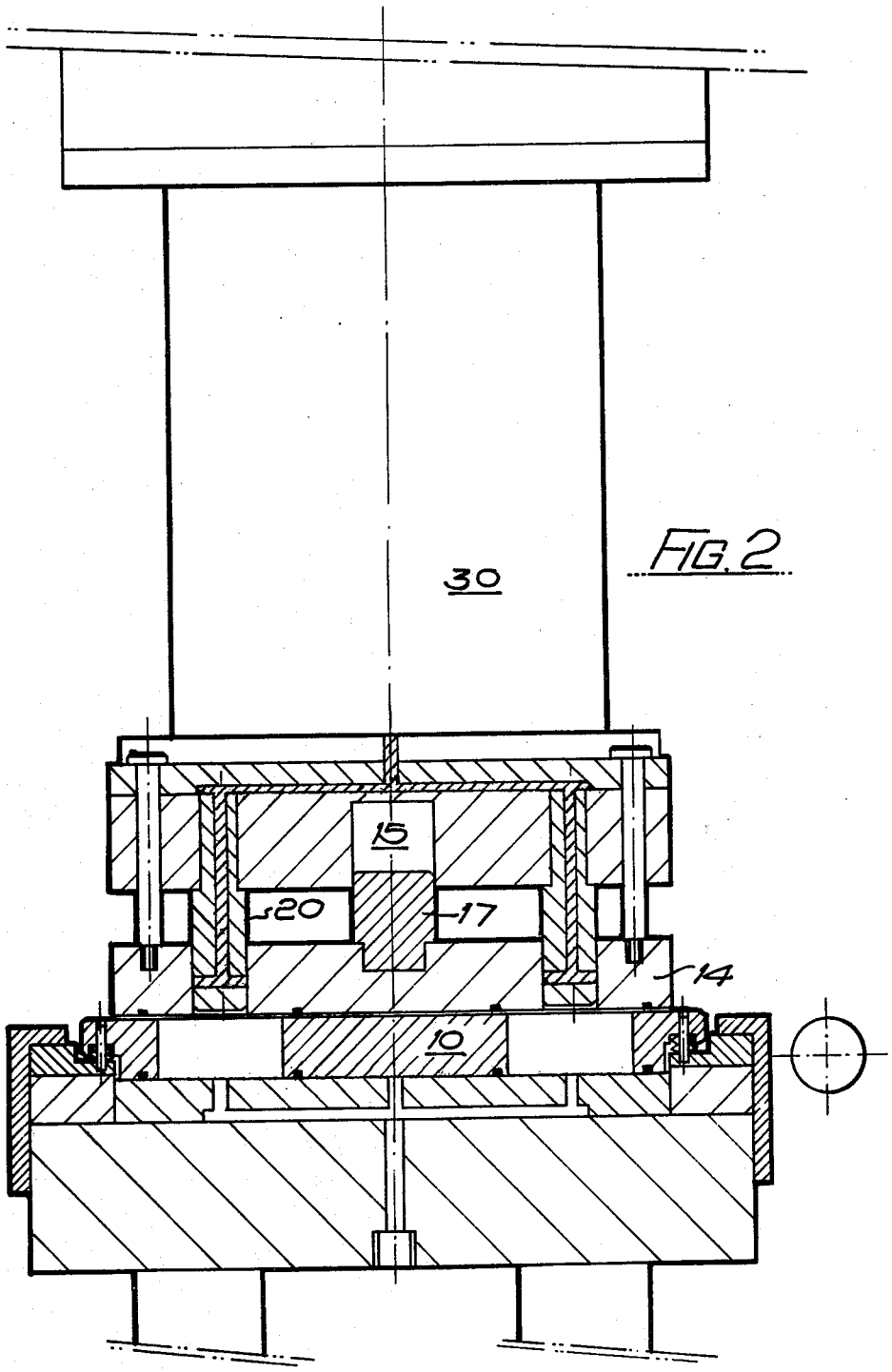
Figure 3:
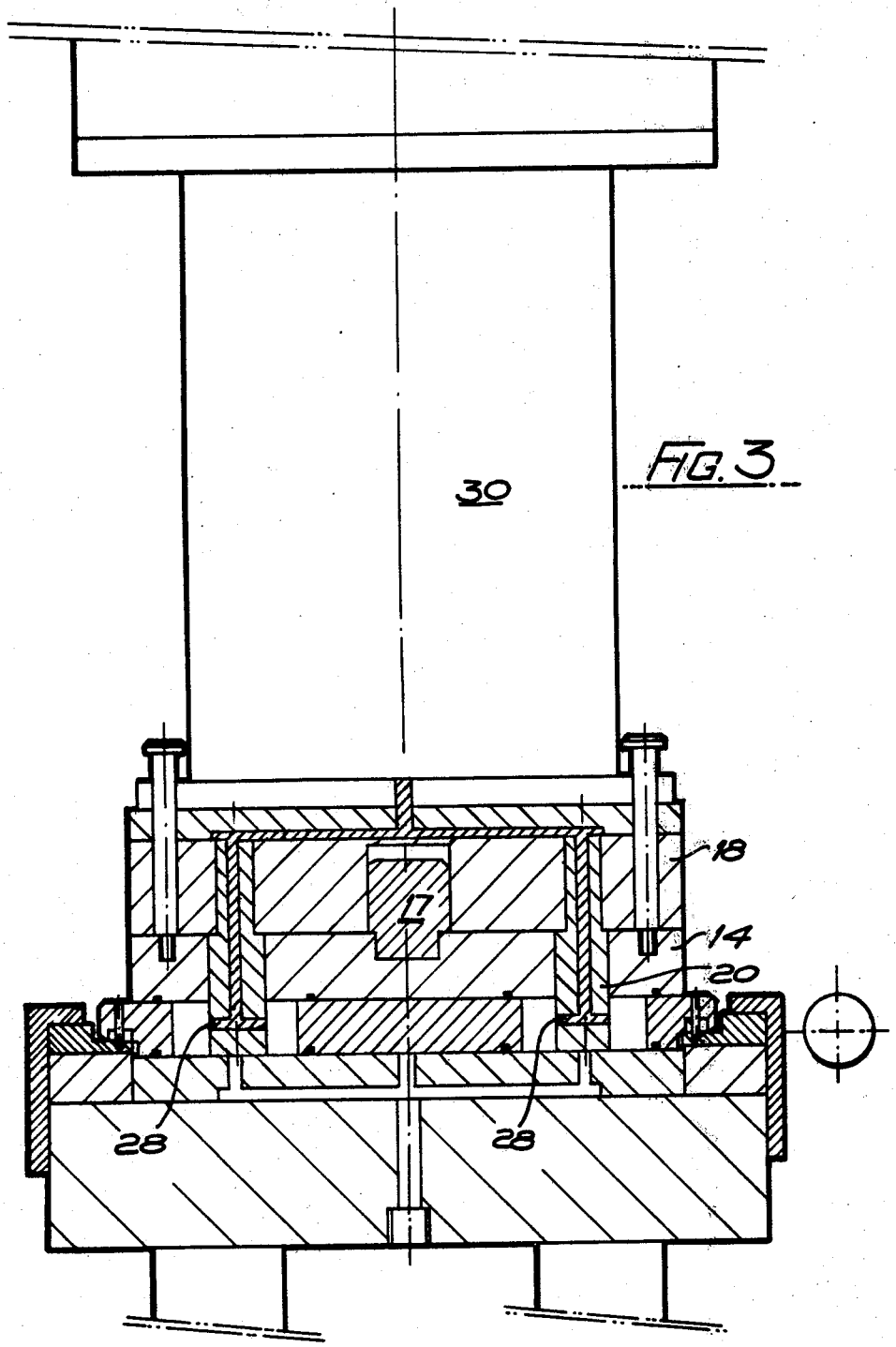
Figure 4:
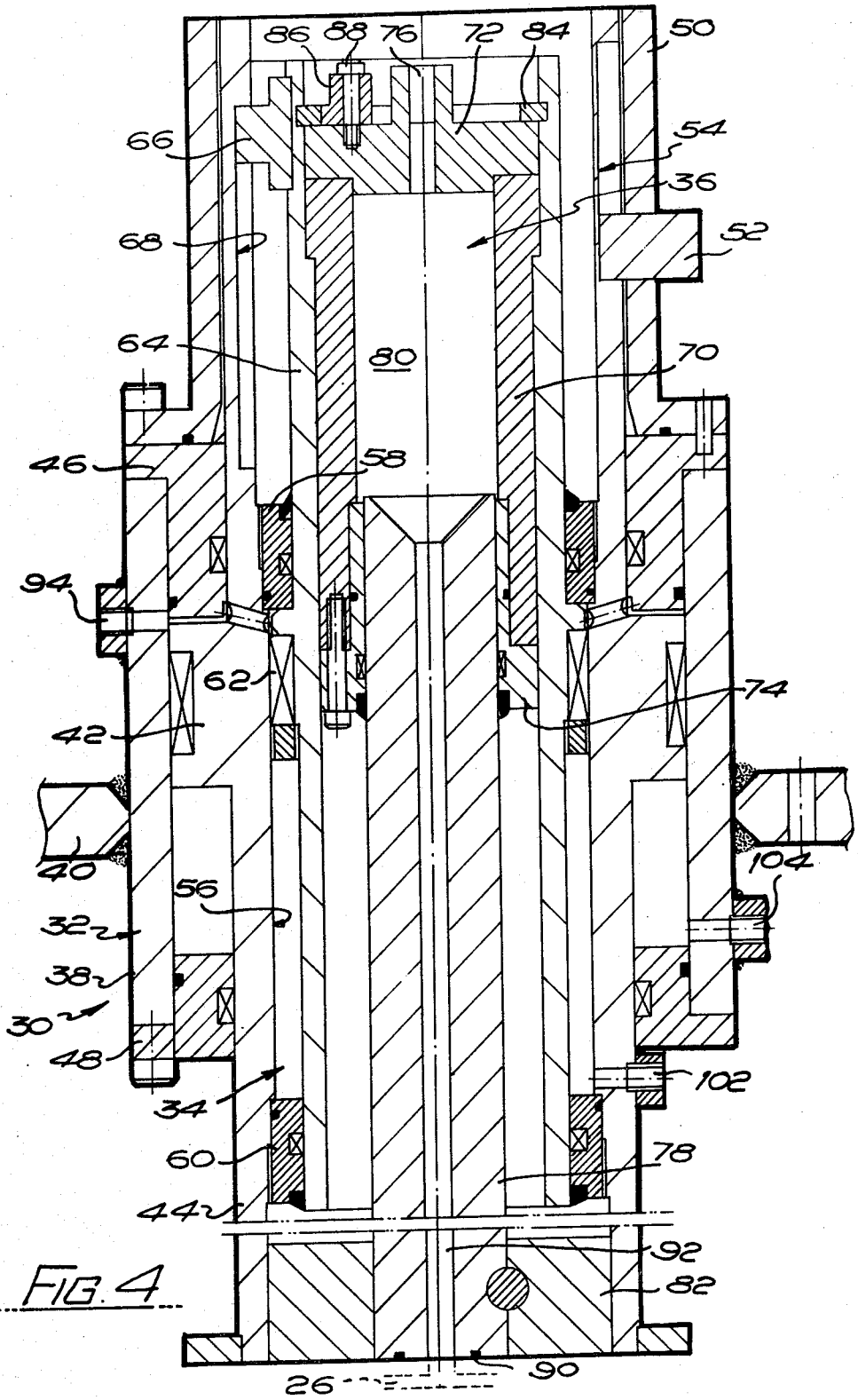
Figure 5:
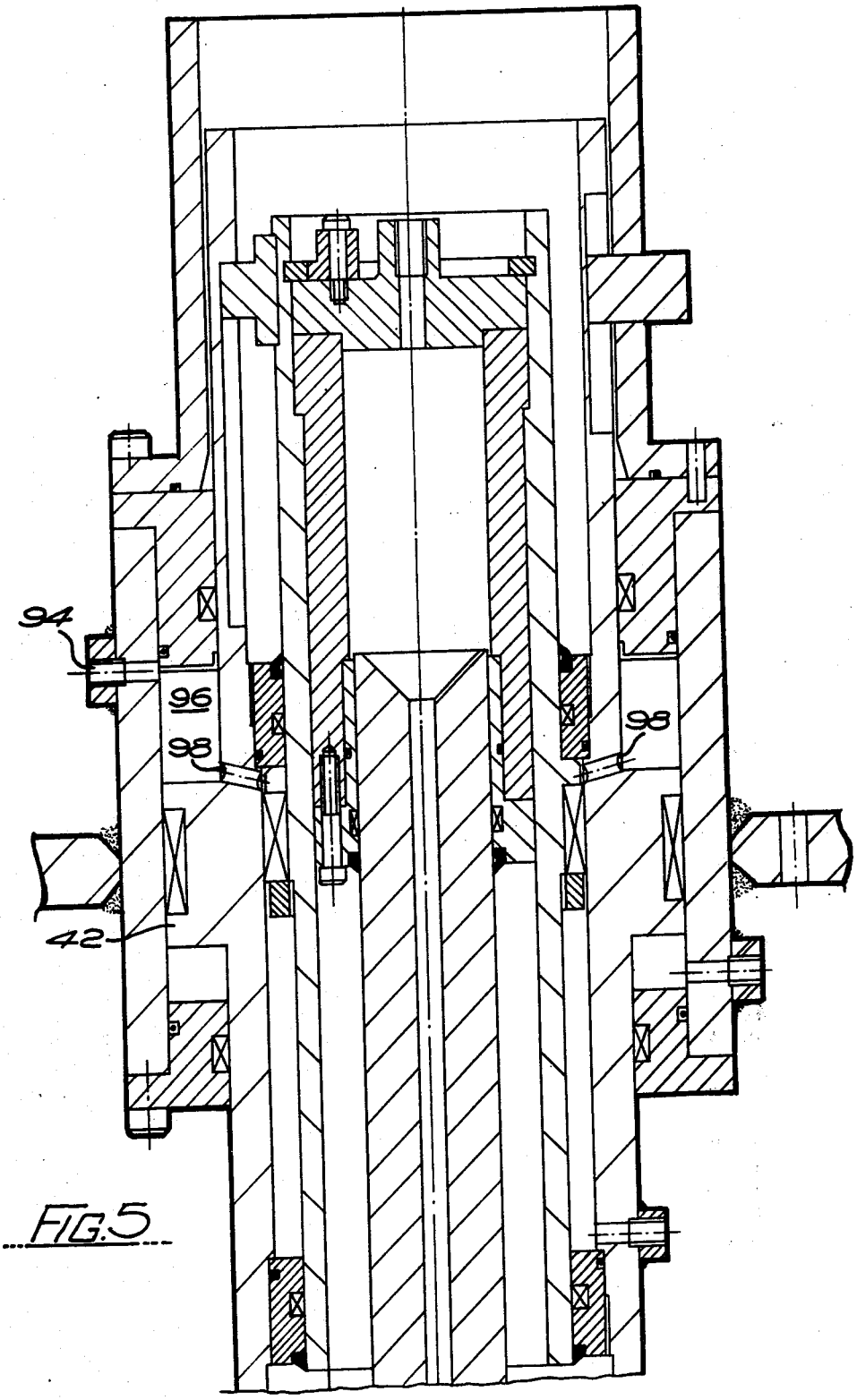
Figure 6:
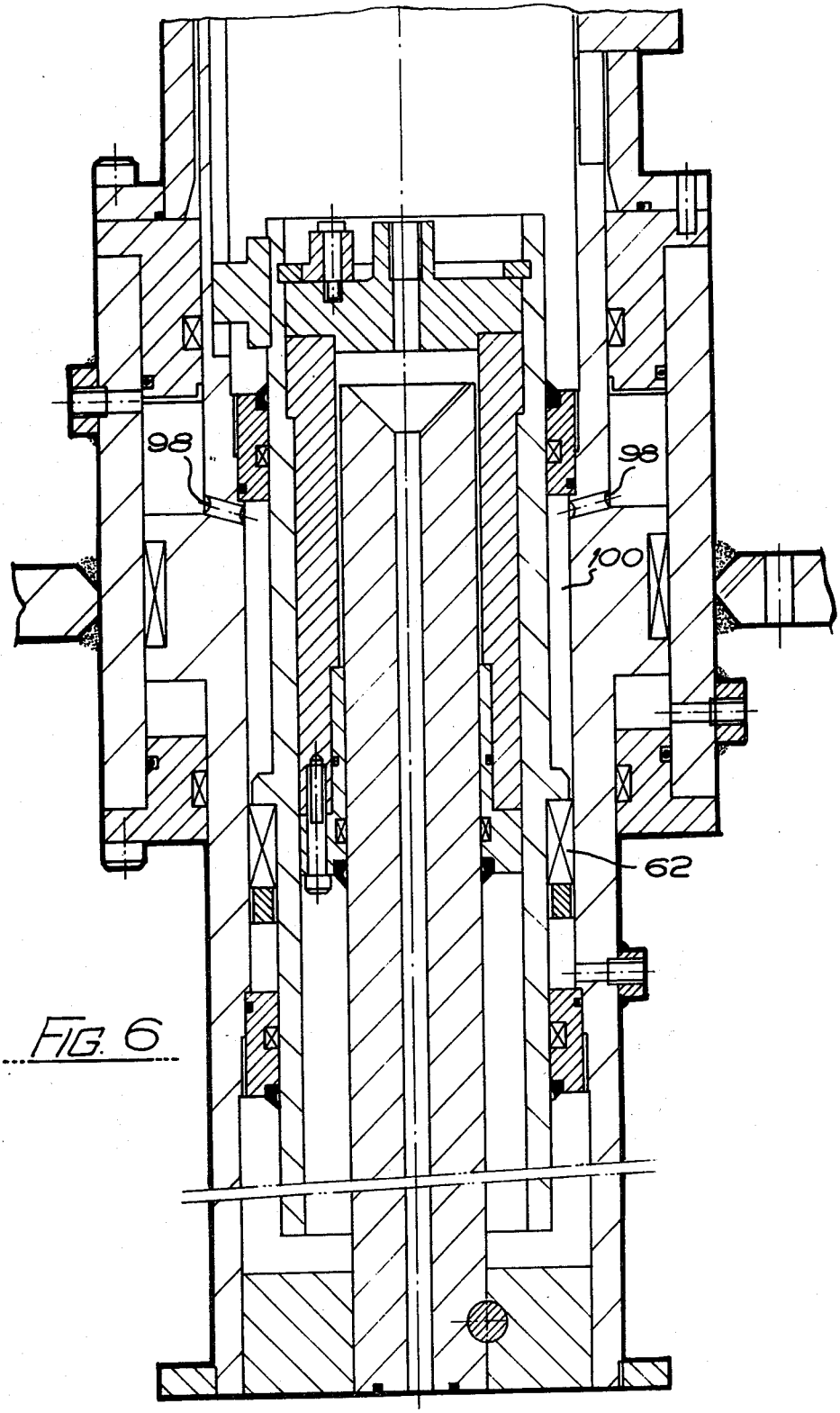
Figure 7:
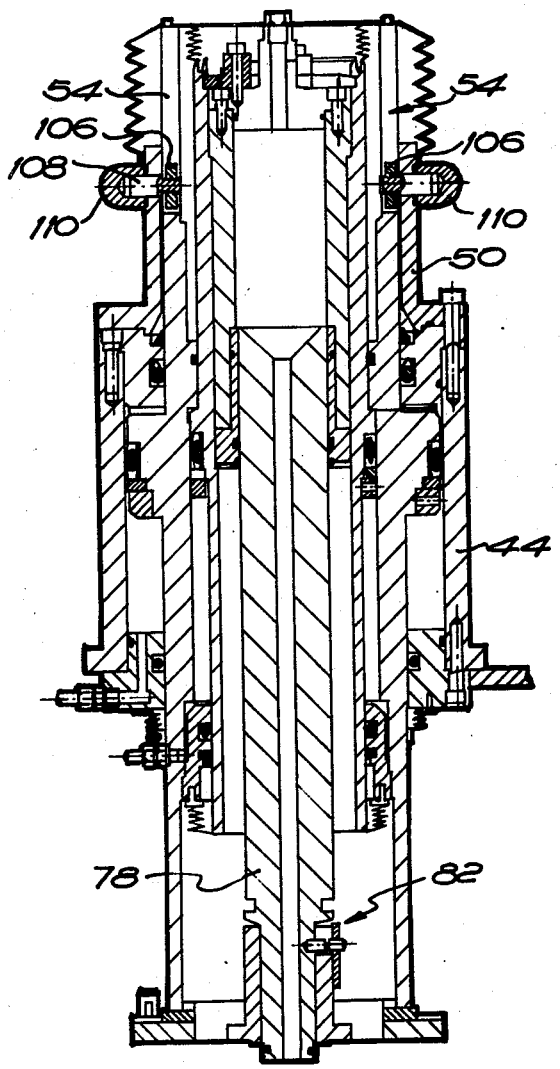

In order that the invention may be fully understood and readily carried into effect, the same will now be described, by way of example only, with reference to the accompanying drawings, of which:

FIG. 1 is a semi-diagrammatic view of apparatus embodying the invention, drawn in open condition, FIGS. 2 and 3 are views similar to FIG. 1 which illustrate successive stages in the forming of a number of moulded components during the operation of the apparatus, FIG. 4 is a sectional view of a hydraulic ram and slurry feed assembly forming a part of the apparatus, FIGS. 5 and 6 are views similar to FIG. 4 which illustrate the assembly during successive stages of operation, and FIG. 7 is a view similar to FIG. 4 which will be referred to when describing a possible modification.

Referring now to FIG. 1 of the drawings, the apparatus there illustrated includes a die plate 10 which is provided with a number of cavities 12 (two such cavities being shown in the drawing) in which respective moulded components are to be formed. The die plate is located beneath a die cover plate 14 suspended on a plurality of headed guide pins 16 which extend slidably through an assembly comprising a core plate 18 and a so-called gallery plate 19. Respective core rods 20 which are to extend into the cavities 12 of the die plate are connected to the core plate and extend slidably through bores in the die plate cover. Resilient sealing elements 22 are provided at the underside of the die cover plate and surround the bores through which the core rods extend.

The arrangement is such that the sealing elements contact the top surface of the die plate when the die is closed, that is to say when the cover plate/gallery plate assembly and the die cover plate are lowered so that the die cover plate contacts the die plate and the upper ends of the die cavities are sealed by said sealing elements. A further downward movement of the core plate/gallery plate assembly causes the core rods to slide through the die cover plate and to extend into the die cavities.

Means are provided whereby the core plate and the die cover plate can be urged apart during at least part of the operating cycle of the machine, these means being constituted by a centrally disposed cylinder 15 which is formed in the core plate and which accommodates a piston 17 which is in contact with the die cover plate. The arrangement is such that when a hydraulic pressure is ducted to said cylinder the die cover plate is urged downwardly relative to the core plate with a controlled pressure.

Means, which need not here be described in detail, are provided whereby liquid can be filtered from a mouldable material filling the die cavities by the establishment of pressure therein.

Means which are provided for ducting a compactable mouldable material to the cavities 12 of the die plate when the die has been closed include feed passages 24 which extend through the core rods from a common feed gallery 26 in the gallery plate, said feed passages communicating with respective cross ports 28 near the ends of said core rods, the arrangement being such that when the core rods have been retracted into the die cover plate, as shown in FIG. 1, the ends of the cross ports are sealed, but when said core rods have been extended through the cavities in the die plate, as shown in FIG. 2, they open into said cavities for the supply of the mouldable material thereto.

The core plate/gallery plate assembly, and with it the core rods 20 and the die cover plate 14, is carried for vertical movement by a hydraulic ram and mouldable material feed assembly indicated 30 in FIG. 1.

Referring now to FIGS. 4 to 6 of the drawings, the hydraulic ram and material feed assembly 30 includes a first annular piston and cylinder assembly generally indicated 32, a second annular piston and cylinder assembly generally indicated 34 and a mouldable material injector generally indicated 36.

The first annular piston and cylinder assembly is constituted by a cylinder 38, connected to a frame part 40 of the apparatus, and an annular piston 42 formed on an elongate tubular member 44 the lower end of which is connected to the core plate/gallery plate assembly, the portions of the tubular member above and below the annular piston extending slidably through upper and lower end caps 46 and 48. A sleeve member 50 upstanding from the upper end cap 46, is provided with a key 52 which engages a slot 54 formed in the upper part of the tubular member 44. Such key and slot location of the elements of the first annular piston and cylinder assembly ensures the correct location of the cover plate on the die plate so that the core rods will be located centrally within the die cavities.

The second annular piston and cylinder assembly 34 includes a cylinder 56 which is formed within a central portion of the tubular member 44, between upper and lower annular end caps 58 and 60. An annular piston 62 which is slidable in the cylinder 56 is formed intermediate the ends of an elongate tubular member 64 the upper and lower ends of which extend slidably through the end caps 58 and 60. Key and slot location between the elements of said second annular piston and cylinder assembly is shown to be effected by a key 66 carried at the upper end of the tubular member 64 and a slot 68 which extends axially along the inner periphery of the upper end of the tubular member 44 (although in fact such key and slot engagement may not be essential between these elements).

The mouldable material injector 36 is located within the upper end of the tubular member 64 and includes a cylinder 70 with upper and lower end caps 72 and 74. The upper end cap 72 includes a screw-threaded feed port 76 for the connection of a material supply line (not shown) in which a non-return valve is located. An upper end portion of a ram member 78 extends slidably through a high pressure seal in the lower end cap 74 and projects into a chamber 80, constituted by the interior of the cylinder 70, which forms a reservoir for a quantity of the mouldable material. A lower end portion of the ram member is secured by means of quick release mechanism, generally indicated 82, in the lower end portion of the tubular member 44. The lower end surface of the ram member is provided with a resilient sealing element 90 so that, as the ram member is located in position by means of said quick release mechanism a material supply passage 92 which extends through the ram member is put in communication with the feed gallery 26 in the gallery plate for the supply of mouldable material to the die cavities and for the maintenance of a high pressure therein for a pre-determined period following the filling of said cavities. The cylinder assembly, that is to say the cylinder 70 and its end caps, is located in a counterbored upper end portion of the tubular member 64 by means of quick release mechanism constituted by a segmental locking ring 84, which engages a groove formed in said tubular member, and by a number of eccentric locking members 86 which are located on respective studs 88.

The arrangement is such that, when a hydraulic pressure is ducted to the hydraulic ram and feed assembly 30 through a supply port 94, the die is closed by the assembly moving bodily downwards relative to the cylinder 38 so that the cover plate overlies the die plate as shown in FIG. 2, further movement of the assembly then causing the core rods to extend into the die cavities as shown in FIG. 3 so that the cross ports open into said cavities. When the die has closed and the core rods have been caused to extend into the die cavities, the hydraulic pressure in an annular chamber 96 above the annular piston 42 (see FIG. 5), communicating with an annular space 100 above the annular piston 62 by way of ports 98, causes the tubular member 64 to move downwards so that the cylinder 70 is moved downwards relative to the ram member (see FIG. 6) and a quantity of the mouldable material is discharged through the supply passage 92 to fill the die cavities.

It will be seen that the pressure of the mouldable material which can be developed in the die cavities is dependent upon the hydraulic pressure which is established in the annular space 100 (see FIG. 6) and that this hydraulic pressure is equal to the hydraulic pressure which holds the die in its closed condition. Consequently, the force with which the die is kept closed is always greater than the force exerted by the pressure within the die cavities (which tends to open the die) and increases in accordance with increasing mouldable material pressure. Any loss of pressure holding the die closed would immediately result in a corresponding decrease in mouldable material pressure and the apparatus is thus inherently safe in operation.

When the moulded compacts of material have been satisfactorily compacted by a sufficient pressure having been maintained in the die cavities for a pre-determined period of time, the tubular member 64 can be moved upwards (to draw a further supply of material into, and thus charging, the chamber 80) by hydraulic pressure admitted through a port 102, and the assembly can then be returned bodily upwards to re-open the die by hydraulic pressure admitted through a port 104. It will be understood that at this stage the compacts will be in a relatively weak state. Consequently, so that the withdrawal of the core rods can be effected without damage to the compacts, a hydraulic pressure is ducted to the cylinder 15 as the hydraulic pressure is admitted through the port 104 to re-open the die. In this way, as indicated in FIG. 2, the die cover plate 14 is held down on the die plate 10 to hold the compacts together whilst the core rods are fully withdrawn to the position shown; at this point the free movement of the headed guide pins through the core plate/gallery plate assembly is taken up and further retraction of the hydraulic ram and feed assembly 30 re-opens the die.

The production of moulded components in a compactable material in the manner described above is advantageous in a number of respects. For example, it makes use of a substantially constant horsepower system in that at the commencement of die filling the available hydraulic horsepower is absorbed in high mouldable material flow velocities but as the pressure of the mouldable material builds up within the die the rate of flow decreases and the available hydraulic horsepower is absorbed in generating high pressure. A further advantage is that the initial consistency of the mouldable material which is mixed for use in the machine is not critical and if a thinner consistency is used the constant horsepower feature referred to automatically compensates for this by increasing the initial material flow rate into the die so that total cycle time is maintained substantially constant (provided the reduced material consistency does not reduce the effective capacity of the chamber 80, that is to say the quantity of the solids, for example slurry powder, contained therein at one filling, to less than the volume of the die cavity, or group of die cavities as the case may be, which must be filled at the commencement of each cycle). The fact that the compacts of material are produced in fixed capacity moulds results in the production of compacts which are virtually identical one to another and it is thus possible to guarantee that, at least in so far as their external shape is concerned, they will all be produced to very close dimensional tolerances. When the compacts are made of a material which will subsequently require "firing", a further advantage is that the density of the so-called "green" compacts will also be substantially identical.

Consequently, the "firing" operation can be carried out without difficulty and without the scrapping of a significant number of the compacts which usually occurs when the compacts are not of like density and when they are not homogeneous.

The apparatus is capable of very high rates of production and down time is reduced to a minimum. When the mouldable material is an abrasive slurry material, for example, for making compacts of magnetic material for producing permanent magnets, the injector may tend to wear relatively quickly. When the injector needs to be replaced it can be removed very quickly by the release of the mechanism 82 which clamps the ram member 78 in position and the release of the eccentric locking members 86 which retain the cylinder 70 in the tubular member 64. The material supply line can then be disconnected from the injector (and will preferably be provided with a quick release self sealing coupling so that this can be carried out very easily and in a minimum of time).

Referring now to FIG. 7 of the drawings, the hydraulic ram and material feed assembly there illustrated is basically similar to that illustrated in FIG. 4. One important difference, however, is that instead of key and slot location of the elements of the first annular piston and cylinder assembly, an oppositely disposed pair of articulated keys 106 are mounted on inwardly projecting spindle portions of respective screwthreaded studs 108 which extend through screwthreaded holes in the sleeve member 50. Domed locknuts 110 are provided for securing the screwthreaded studs in position. The articulated keys engage oppositely disposed slots 54 in the upper part of the tubular member 44. The assembly is also shown to incorporate a number of other refinements. For example, the quick release mechanism 82 for securing the lower end of the ram member 78 to the gallery plate has been altered. In addition, the lower end of the ram member is shown to have spigot connection with the gallery plate.

In a modification of the assembly illustrated in FIG. 7, the spindle portions of the studs on which the articulated keys 106 are mounted are formed eccentrically to the screwthreaded portions so that the positions of the articulated keys can be adjusted. In this way the alignment of the fixed and movable parts of the dies can be adjusted (so that in the illustrated apparatus the core rods will extend concentrically through the die cavities). The keys will be adjusted in position so that one of them acts against one wall of its slot to hold the sleeve member against rotation in one direction and the other key acts against one wall of its slot to hold the sleeve against rotation in the other direction.

Various other modifications may be made without departing from the scope of the invention. For example, the die may be provided with any number of cavities from one upwards (provided of course that the volume of the die cavity, or group of die cavities, which must be filled at the commencement of each moulding cycle, is less than the effective capacity of the chamber 80 having regard to the consistency of the mouldable material and provided also that the force tending to separate the elements of the die, which is the product of the material pressure and the effective cross sectional area of the die cavity or group of die cavities, as the case may be, is always less than the clamping force). It will also be understood that the piston and cylinder arrangement 17, 15 could be replaced by a coil compression spring acting to urge the core plate and die cover plate apart (although it is thought that a spring would not be quite as satisfactory because it would exert a variable force whereas a piston can exert a constant force dependent on the fluid pressure behind it). The articulated keys 106 in FIG. 7 could be replaced by respective rollers mounted for rotation on the spindle portions of the studs 108.

Other means could be used for charging the injector with mouldable material, for example, by a so-called pre-fill arrangement. That is to say, a low pressure arrangement could be used for filling the die cavities with mouldable material, the pressure intensifier only being brought into use to establish the required pressure in the die cavities sufficient to effect adequate compaction.

Means may be provided to automatically increase the period of time slurry pressure is maintained in the die cavities to compensate for progressive filter blockage as the apparatus is used.

Prefilling of the dies at low pressure may be accomplished by external means of pumping, the injector then being used only to generate high pressure. Also, the injector pump may be multi-stroked to increase the volume of mouldable material injected into the dies to more than the volumetric capacity of the injector chamber, providing of course that the total area of the die cavities at the die plate/die cover plate joint face is not increased beyond permissible limits.

When the apparatus is for moulding permanent magnet compacts in a mouldable slurry material including ferrite particles, means may be provided for maintaining a magnetic field around the material in the or each die cavity during each moulding operation so that the particles of ferrite material are appropriately orientated whilst still suspended in the slurry. In addition, when the mouldable material is a slurry material including ferrite particles for producing permanent magnet compacts, an external means for pumping, where the injector is used only to generate high pressure, could be constituted by electro magnetic means producing an induction effect within a slurry flow line.

What we claim and desire to secure by Letters Patent is:

1. In moulding apparatus, a die having at least one die cavity, means constituted by a first piston and cylinder arrangement for opening and closing the die, and means constituted by a second piston and cylinder arrangement for injecting mouldable material into the die, the second annular piston and cylinder arrangement being disposed within the first piston and cylinder arrangement.

2. Moulding apparatus according to claim 1, in which the means for injecting the mouldable material into the die includes an injector assembly constituted by a ram member, through which extends a material feed passage, the ram member slidably extending into a cylinder forming a reservoir for a quantity of the mouldable material, said cylinder being carried by the piston of the second piston and cylinder arrangement.

3. Moulding apparatus according to claim 2, in which quick release means are provided whereby the cylinder which forms a reservoir for a quantity of the mouldable material, and the ram member which extends into it, can easily be removed for replacement.

4. Moulding apparatus according to claim 1, in which the first annular piston and cylinder arrangement is hydraulically connected to the second annular piston and cylinder arrangement so that the clamping force for holding the die closed increases in accordance with the pressure of the mouldable material and so that any leakage of hydraulic pressure for holding the dies closed will immediately reduce the pressure of the mouldable material.

5. Moulding apparatus according to claim 1, for moulding permanent magnet compacts in a mouldable slurry material including ferrite particles, means being provided for maintaining a magnetic field around the material in the at least one die cavity during each moulding operation so that the particles of ferrite material are appropriately orientated whilst still suspended in the slurry.

* * * * *